US005277507A

United States Patent [19]

Garcia-Cano et al.

[11] Patent Number: 5,277,507

[45] Date of Patent: Jan. 11, 1994

[54] SHEET FEEDER FOR ENGRAVING PRESS

[75] Inventors: Henry Garcia-Cano, Pomona; Monte L. Justesen; Carl Weise, Jr., both of Los Angeles, all of Calif.

[73] Assignee: Stuart F. Cooper, Co., Los Angeles, Calif.

[21] Appl. No.: 865,133

[22] Filed: Apr. 8, 1992

[51] Int. Cl.[5] ..... B41J 13/26

[52] U.S. Cl. ..... 400/631; 400/579; 400/630; 271/236

[58] Field of Search ..... 101/485, 231, 232; 400/601, 579, 630, 631, 632, 632.1, 633, 633.1, 633.2, 635, 645, 647, 709, 709.2, 708; 271/245, 246, 253, 255, 226, 228, 236, 244

[56] References Cited

U.S. PATENT DOCUMENTS

| | | | |
|---|---|---|---|
| 2,699,940 | 1/1955 | Huck et al. | 271/254 |
| 2,825,281 | 3/1958 | Heywood | 101/287 |
| 3,893,392 | 7/1975 | Brenn et al. | 101/150 |
| 3,999,480 | 12/1976 | Yamamoto et al. | 101/177 |
| 4,203,588 | 5/1980 | Joosten | 271/246 |
| 4,480,826 | 11/1984 | Kaneko | 271/103 |
| 4,533,239 | 8/1985 | Back | 271/236 |
| 4,572,071 | 2/1986 | Cappel et al. | 101/231 |
| 4,743,129 | 5/1988 | Keryhuel et al. | 400/579 |
| 4,801,135 | 1/1989 | Povio | 271/157 |
| 4,867,058 | 9/1989 | Luckhurst | 101/232 |
| 5,088,848 | 2/1992 | De Falco et al. | 400/579 |
| 5,103,733 | 4/1992 | Drapatsky et al. | 101/485 |

FOREIGN PATENT DOCUMENTS

| | | |
|---|---|---|
| 2710448 | 9/1978 | Fed. Rep. of Germany . |
| 742546 | 5/1952 | United Kingdom . |

*Primary Examiner*—Edgar S. Burr
*Assistant Examiner*—Ren Yan
*Attorney, Agent, or Firm*—Poms, Smith, Lande & Rose

[57] ABSTRACT

The present invention employs a pneumatically driven front stopper which maintains multiple contact points with a sheet combined with a pneumatically driven push guide to position a sheet beneath an engraving press. An electrically driven sheet supply and plurality of drive belts bring sheets to the front stopper. A plurality of fans cause the imprinted portion of an engraved sheet to raise upwards, preventing smearing of wet ink, and encourage drying of the ink. The sheet feeder is driven by pneumatic actuators which are triggered by a cam assembly connected to the main drive shaft of the engraving press.

4 Claims, 2 Drawing Sheets

FIG. 2
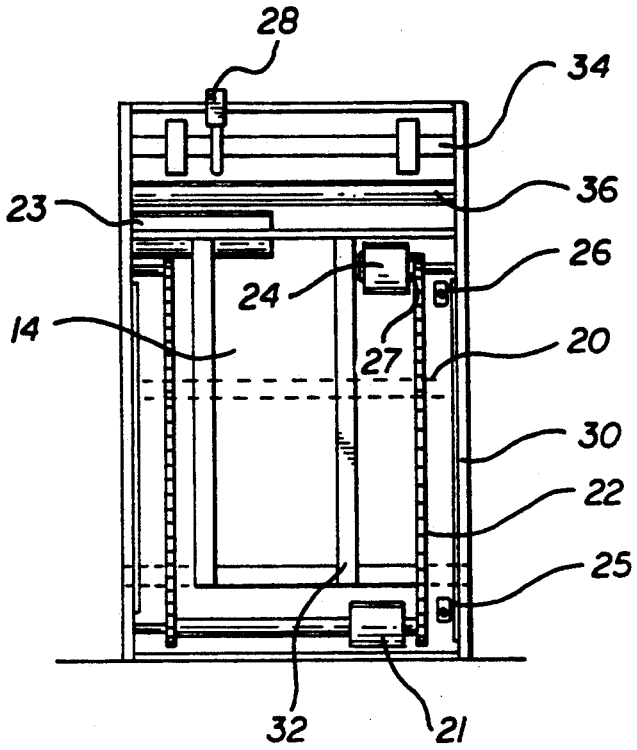
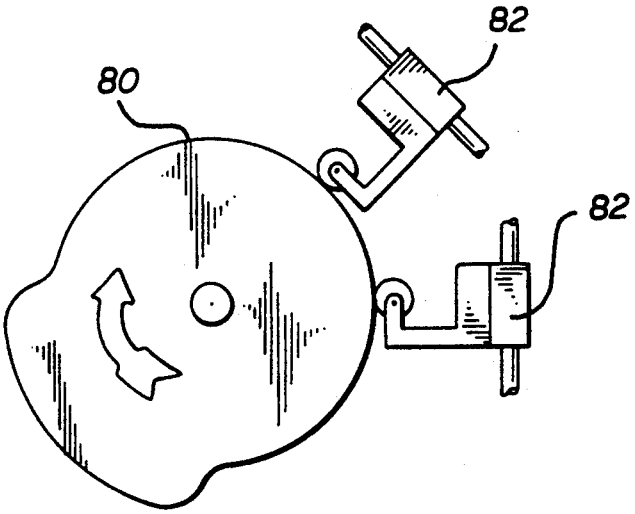
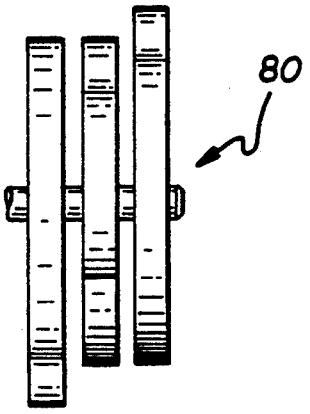
FIG. 3
FIG. 4

SHEET FEEDER FOR ENGRAVING PRESS

FIELD OF THE INVENTION

The present invention relates generally to engraving presses and, more particularly, to document or sheet feeders for automatically feeding and positioning a sheet of paper or other article to be imprinted into position where it can be imprinted by an engraving press. The feeder then conveys the imprinted document away from the engraving press.

BACKGROUND OF THE INVENTION

Engraving presses have existed for a relatively long time, with many designs remaining substantially unchanged since their invention. Automation is difficult without substantially redesigning the engraving press. Large printing presses including 3 and 4 color printing presses utilize feed through roller designs where the print is applied by a circular drum. This is similar to newspaper printing press designs. Engraving presses have not generally progressed to this point. Engraving presses must apply a force sufficient to deform and reshape the surface of an imprinted sheet. Circular drum technology is generally not fitted for this approach.

Numerous engraving presses are currently manually fed, with an operator physically positioning a sheet to be engraved in an engraving press. Several attempts of automating the sheet feeding process have been made.

U.S. Pat. No. 3,893,392, issued to Brenn, et. al., discloses an automatic feeding mechanism designed to feed envelopes into an engraving press. The Brenn apparatus consists of an envelope storage section located above the engraving area. A combination of vacuum actuated suction cups and a mechanical guide is raised to grab each envelope to be engraved. When lowered, this "apparatus" holds an envelope. The apparatus is then moved towards a belt feeder, and the vacuum from the suction cups released to that the envelope may travel in a belt feed mechanism consisting of an upper and lower belt. The mechanical guide to help grab the envelope helps maintain the position of the envelope as the envelope initially enters the belt feed mechanism. No guide or orientation apparatus ensures positioning once the envelope is grasped between the upper and lower belts.

An optical sensor detects the presence of an envelope traveling along the belt feed mechanism. The envelope interrupts a light transmitted beam from a light source to a sensor positioned. This interruption of the light beam causes the belt to stop. An engraving press is then actuated to imprint the envelope. Once the envelope is imprinted, the belt drive is released, and the envelope allowed to continue along the belt path. No positioning apparatus ensures that the envelope is properly located underneath the engraving press. The system relies on the optical sensor and immediate braking action to stop the belts, thus stopping the movement of the envelope at the precise location desired. The Brenn feeder relies heavily on electrical switches, combinational logic, and actuation of the mechanical apparatus by an electronic circuit in order to accomplish its function.

U.S. Pat. No. 2,825,281, issued to Haywood, discloses an apparatus for feeding sheets to a stamping apparatus, more commonly called an engraving press. Haywood uses a vacuum mechanism to lift individual sheets off a paper supply stack. The vacuum assembly is rotated and the sheets fed in between a pair of transfer rollers. The transfer rollers convey the sheet to the top of a transfer platform. The sheet rests on several belts which move along the surface of the transfer platform. The sheet comes to rest on the transfer platform when it comes into contact with stops which are located immediately above the belts on the top of the transfer platform. The sheet is then in position to exit the transfer platform at right angles to the transfer platform and the belts on which the sheet has been riding. Movable rollers come into contact with the edge of the sheet, causing the sheet to begin to travel along a second set of belts which are positioned at right angles to the first set of belts.

As the sheet travels along the second set of belts, it comes into contact with a stop. A roller maintaining contact between the sheet and belt is raised, and a bar pushes the sheet toward the printing head to position the sheet. Vertical rods are then lowered to hold the sheet in place, and the sheet is imprinted. During this process, the belts on which the sheets have been riding continue to move. After being imprinted, the sheet is released by the vertical rods, the stop is raised, and a roller lowered on top of the sheet to force the imprinted sheet to again move along the belts away from the imprinting area.

The Haywood apparatus employs a vacuum to load sheets onto the first table, and thereafter employs a series of mechanical arms linked to a cam arrangement in order to operate the bulk of the apparatus. A paper sensor is formed at the end of the first set of belts by placing a metal strip on top of the table such that when the sheet is fed into position against the positive stops located above the belts, an electrical circuit is mechanically interrupted by the sheet of paper.

Apparatus of the type described in Haywood and Brenn has been employed in order to more rapidly feed an engraving press, thereby reducing the number of manual operations required in order to imprint an envelope or other sheet.

This prior art fails to provide a reliable, repeatable, easy to use sheet feeder which can effectively replace manual operation. The prior art is also fairly difficult to set-up and maintain. The Brenn invention has a configuration specifically designed for envelopes. It cannot easily accommodate $8\frac{1}{2}\times 11$ sheets or other larger sheets which are less rigid than an envelope. The "top down" feed tray and mechanism cannot hold larger sheets, and the feed mechanism poorly adapted to feed highly flexible sheets. Positioning beneath the imprinting head is not repeatably assured. The sheet being fed may become tilted or otherwise shift position either in the feed tray or while being transferred to the on the sheets varying.

The Haywood invention requires two sets of belts positioned at right angles to each other. Mechanical stops in the sheet's path establish orientation of the sheet on the first set of belts. Subsequent transfer to a second set of belts at right angles to the first set may allow the orientation of the sheet to change. A single mechanical stop halts movement of the sheet, along the second set of belts. This mechanical stop must be accurately positioned or the sheet may rotate about the mechanical stop. The push bar must be similarly accurately positioned to prevent rotation of the sheet about the push bar.

Haywood also requires positive clamping by vertical rods to keep the sheet in place during imprinting. The Haywood apparatus is driven by a large number of mechanical rods and cams which must be precisely adjusted. A change in the size of the sheet requires redesign of numerous rods and cams.

Neither Brenn nor Haywood are oriented to accommodate printing on the lower surface of a sheet, which is a common press configuration.

The need therefore exists for a reliable sheet feeder which repeatably locates the sheet to be imprinted in precisely the same location for imprinting. A feeder is also needed which can easily accommodate a large variety of sheet sizes and rigidity, and is easy to operate.

SUMMARY OF THE INVENTION

The present invention provides an automatic sheet feeder for an engraving press which is repeatable, reliable, and rapidly and easily adaptable to existing press configurations. The present invention repeatably and accurately positions sheet beneath the ram of an engraving press. The present invention also provides a means for elevating the imprinted sheet to prevent it from coming in contact with any surface or other sheet which may smear the ink after the sheet has been imprinted, but before the ink has fully dried. The present invention can be adapted to accommodate a large variety of different size sheets. The present invention can be pneumatically or electronically driven, and operates in a synchronous fashion to the associated engraving press.

It is an object of the present invention to provide a reliable apparatus which automatically feeds sheets to an engraving press, accurately and repeatably positions the sheets beneath the engraving press, and conveys those sheets away from the engraving press once the imprinting operation has been completed.

It is a further object of the present invention to precisely align the sheets being fed to precisely locate and imprint the sheets. It is an object of the present invention to prevent smearing of the ink on the sheets by contact with the sheet feeder.

It is a further object of the present invention to provide an automatic feeder apparatus which can operate without the need for continuous manual operating or adjustment.

It is a further object of the present invention to provide an automatic sheet feeder which does not leave marks, indentations, registration indicia or other evidence that the sheets have been handled by an automatic sheet feeder. It is a further object of the present invention to provide an automatic sheet feeder which is relatively easy to set-up and operate.

In accordance with these objects, a sheet feeder includes a sheet stack, a sheet feeder which loads individual sheets onto a flat table, belts positioned along the table to convey the sheets towards and past an engraving press, a sheet positioning apparatus which precisely locates each sheet beneath the engraving press, and a series of fans or blowers which elevate the imprinted portion of a sheet as the sheet is conveyed past the engraving press. The sheet feeder is driven by cams or position detectors which are synchronized to the main shaft of the engraving press.

The present invention provides accurate, repeatable, automatic sheet positioning apparatus for engraving presses. The present invention provides a versatile, easy to set-up and repair sheet feeder utilizing a minimum amount of motion or moving parts.

BRIEF DESCRIPTION OF THE DRAWINGS

FIG. 2 is an end elevation view of a sheet feeder stack for the sheet feeder apparatus.

FIG. 3 is an end elevation view of an operating cam assembly for actuating various elements of the apparatus.

FIG. 4 is a side view of the operating cam assembly.

DETAILED DESCRIPTION

Figures 1, 5, 6:
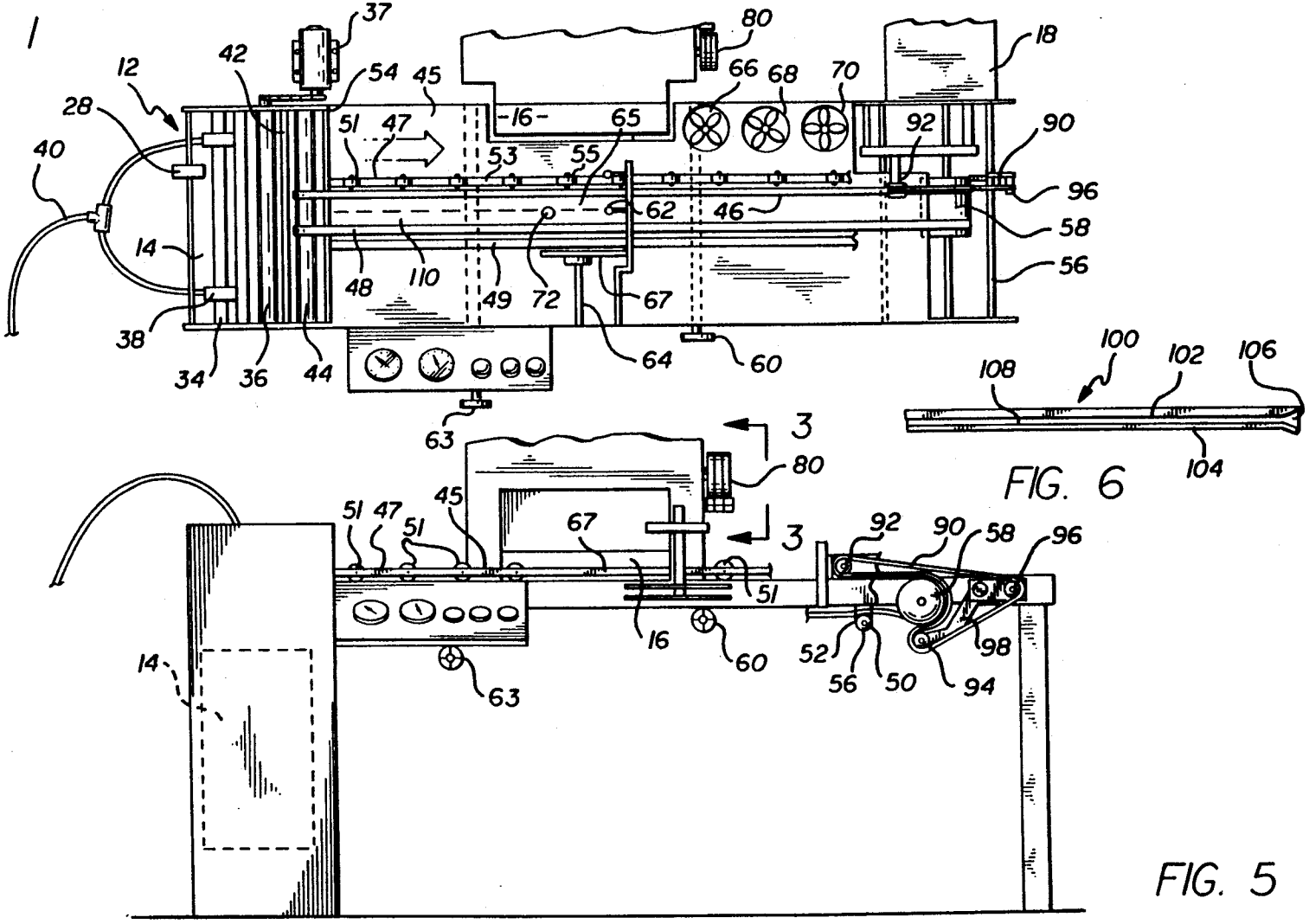
FIG. 1 is a top plan view of the sheet feeder apparatus according the present invention.
FIG. 5 is a diagrammatic overview showing some of the significant parts of the sheet feeder.
FIG. 6 is an elevation view of the guide bar system used for feeding envelopes and small sheets.

In order to achieve accurate, repeatable operation by an automatic sheet feeder, an apparatus as shown in FIG. 1 is employed. An overview of the present invention is shown in FIG. 5. A sheet feed unit 12 is located to the left of press 16. Sheet supply 14 originates below the surface of table 45. Referring to FIG. I, a sheet feeder 12 includes a sheet supply unit for feeding a supply of paper or other sheets 14 to be imprinted one sheet at a time to press 16. Press 16 is an engraving press which imprints each sheet fed to it. Sheets are transferred to conveyor belt 18 where they are transported to a finished product area (not shown) after imprinting. The speed of belt 18 is sufficiently slow to allow the ink applied by press 16 to dry, and is fast enough to avoid having to slow the operation of sheet feeder 12 or press 16 to accommodate conveyor belt 18. In one preferred embodiment, press 16 is "The Modern" 3×8 steel die and plate stamping press manufactured by Modern Die and Plate Press Manufacturing Co. In another preferred embodiment, press 16 is a 4½×9 Carver press, manufactured by Carver, Inc.

Sheet feeder 12 is shown in more detail in FIG. 2. Sheet supply 14 rests on a sheet tray 20. Sheet tray 20 is driven in the vertical direction by sheet tray drive train 22. Sheet tray drive train 22 is driven by electric drive motor 24 through drive train 27. The use of an electric drive motor 24 eliminates mechanical drives of a type which have been employed in some sheet feed mechanisms. The sheet feeder also contains size control brackets 32 which ensures consistent positioning of sheet supply 14 on sheet tray 20. Tray guide 30 maintains the position and prevents wobble of the sheet tray 20 during operation. An electric brake 21 provides for rapid stopping of the movement of sheet tray 20. Electric brake 21 is disengaged while power is on.

A stack height adjuster 28 is located near the top of sheet feeder. This stack height adjuster could be located along the side of the sheet feeder, or in another suitable location. The stack height adjuster determines the positioning of the top of sheet supply 14. This is important so that individual sheets from sheet supply 14 can be grabbed by sucker arm assembly 34 and fed into feed roller 36. If stack height adjuster 28 is too low, then sucker arm assembly 34 will be too far away from sheet supply 14 to grab a sheet, and no sheets will feed. Stack height adjuster 28 must be adjusted to ensure continuous successful operation of sucker arm assembly 34, and avoid the intermittent failure of sucker arm assembly 34 to grab a sheet. Limit switch 25 prevents the sheet drive tray 20 from being lowered too far, damaging the apparatus. Similarly, limit switch 26 prevents the sheet drive tray 20 from being raised too high.

Sucker arm assembly 34 is connected to a vacuum (not shown) by the attachment of vacuum hose 40. Sucker arm assembly 34 rotates about a longitudinal axis parallel to a feed roller 36. Two openings 38 located on sucker arm assembly 34 are initially pointed downwards toward paper supply 14. The openings in the preferred embodiment are a hollow finished metal surface, however, rubber suction cups may be used. When a sheet is to be fed to press 16, a vacuum is applied to openings 38. This causes the sheet on the top of sheet supply 14 to be grabbed by sucker arm assembly 34. Sucker arm assembly 34 then rotates towards feed roller 36, and the leading edge of the sheet comes in contact with feed roller 36.

Feed roller 36 is driven by feed motor 37 and pulls the sheet as the vacuum applied to vacuum openings 38 in sucker arm assembly 34 is shut off. Feed roller 36 conveys the sheet towards drive roller 44. This causes the sheet to be placed on top of table 45 and drive belts 46 and 48. Drive belts 46 and 48 are approximately ¼ inch wide endless belts which extend the length of table 45. It is recognized that wider or narrower drive belts, or a greater or fewer number of drive belts may be employed in this configuration. Feed motor 37 is located beneath table 45, but is shown adjacent to table 45 for clarity. Drive belt motor 23 is located beneath table 45 and behind sheet feeder 12 as shown in FIG. 2.

Drive belts 46 and 48 rotate about drive roller 44 at the paper supply end of table 45, and about delivery roller 58 at the opposite end of table 45. Drive belts 46 and 48 are driven by drive roller 44 which is in turn driven by an electric motor (not shown). The tension of drive belts 46 and 48 is adjusted by idler arms 50 and 52 respectively. Idler arms 50 and 52 rotate about idler arm bracket 56. Idler arm 50 is beneath drive belt 46 as shown in FIG. 1, and behind idler arm 52 as shown in FIG. 2.

Belt guides 47 and 49 are located immediately above drive belts 46 and 48 respectively. Belt guide 49 is shown adjacent to drive belts 46 and 48 in FIG. 1 to avoid confusing the reader. Belt guides 47 and 49 hold sheets against drive belts 46 and 48 ensuring that the sheets proceed along the top of table 45. Belt guide 49 is comprised of spring steel and is designed to allow a sheet to "slip." In this manner, the sheets can be stopped while drive belt 48 continues to move. This is advantageous over the prior art which uses both upper and lower drive belts and requires the belts to stop when a sheet stops (or the sheet will be defaced or deformed). Belt guide 47 consists of a series of ball-bearing filled rollers 51 located in roller guide 53. The rollers 51 apply pressure to the top of the sheet in a manner similar to spring steel belt guide 49. Roller 55 is adjustably positioned in roller guide 53 so that it is located slightly behind the sheet as the sheet rests against a front stopper 62. This location of roller 55 reduces the force applied to the sheet in the direction of motion of belt 46 allowing the sheet to be positioned without applying force to the sheet which may cause the sheet to buckle or fold when the sheet encounters the front stopper 62.

In the preferred embodiment, table 45 is approximately 20 inches wide, and 80 inches long. It is comprised of stainless steel or other suitable material which will not rust, discolor or cause any marks to be placed on the sheets as they are transported by belts 46 and 48 across the length of table 45. Stainless was also selected because of the ease of cleaning. It is recognized that other materials may possess similar characteristics, or may be coated so that they may possess similar characteristics to the material used herein.

After the sheet has been picked up by sucker arm assembly 34, fed through feed roller 36 and across drive roller 44, the sheet rides along on belts 46 and 48. The sheet is transported across table 45 until the leading edge of the sheet encounters the front stopper 62. The front stopper 62 is oriented in a predetermined, desired relationship to press 16. For imprinting letterhead and the like, the front stopper 62 is made up to two fingers which extend downward, towards the top of table 45, perpendicular to the direction of the type in press 16. The front stopper 62 can be replaced with an irregularly shaped guide to accommodate irregularly shaped sheets. The front stopper 62 can also be oriented at an angle to press 16 if it is desired to imprint the sheet in a direction other than perpendicular to the length or width of the sheet.

A tab 65 is placed on table 45 to cause the leading edge of the sheet to be raised slightly off of table 45. This assures contact with the front stopper 62. Tab 65 is preferably a piece of tape affixed to table 45. The tape is folded back on itself at the trailing edge of the tape. The leading edge of the tape is affixed to table 45 and encounters the leading edge of the sheet before the trailing edge of the tape. Tab 65 may also be comprised of spring steel affixed to or below the surface of table 45.

Hold down bar 67 is positioned over the sheet when the sheet is resting against the front stopper 62. Hold down bar 67 is bent upwards toward the front of the hold down bar 67 in order to more easily guide the sheet under hold down bar 67. This provides added protection against the sheet buckling or rising up off of table 45 in an undesired manner.

Push guide 64 gently move the sheet toward press 16 while the sheet is resting against the front stopper 62. The front stopper 62 maintains contact with the sheet after operation of push guide 16. Push guide 64 does not move the sheet so rapidly that the sheet overshoots the target printing position. A positive stop located in, or behind press 16 (on the opposite side of press 16 from push guide 64) may be employed. The inventors have determined that such a positive stop may unduly interfere with operation of press 16, may restrict the printing area available on the sheet, or may cause very flexible sheets to buckle. For this reason, a push guide which operates at a relatively slow speed, such that the push guide does not lose contact with the sheet during operation of the push guide or interfere with operation of the press 16 is preferred.

By maintaining continuous motion of drive belts 46 and 48, the sheet is continuously pushed against the front stopper 62. Thus, if the sheet is slightly jarred by the operation of push guide 64 and loses contact with the front stopper 62, the sheet's position resting against the front stopper 62 will be quickly re-established. Unless severe jarring has occurred, the sheet will be properly resting against the front stopper 62 before imprinting occurs.

An optical sheet sensor 72 is located such that a sheet which is resting against the front stopper 62 will result in an indication that a sheet is present. In the preferred embodiment, sheet sensor 72 is a reflective type optical element. Sheet sensor 72 is located above table 45. Light originates in sheet sensor 72, is reflected off of a reflective surface on table 45, and detected by sheet sensor 72. Sheet sensor 72 may operate in the visible light or infrared light region. The inventors have found that a reflective sensor more consistently detects the presence or absence of a sheet than does a transmittive type sensor such as that employed in Brenn.

Transparent sheets, or extremely thin sheets which do not block the light transmitted by sheet sensor 72 require a mechanical sensing mechanism. This can be in the form of an electrical contact as in Haywood or other physical sensing equipment. Since most sheets which are imprinted are opaque, or at worst translucent, this difficulty will rarely arise. Sheets to be imprinted are detected by the interruption of the beam of light transmitted by sheet sensor 72. If sheet sensor 72 does not detect a sheet in place, then the operation of press 16 is halted. This avoids damage to press 16, and provides a means for indicating to an operator that the sheet supply 14 has been exhausted, or misfed.

After press 16 has imprinted the sheet, the front stopper 62 is raised, allowing the sheet to move away from press 16 (and away from paper supply 14). In some press configurations, ink is applied to the lower surface of the sheet. In order to avoid smearing, smudging, or streaking the ink on the imprinted sheet, fans 66, 68, and 70 are employed to blow air upwards from beneath the surface of table 45. This causes the bottom side of the sheet which has been imprinted by press 16 to raise up or float on a cushion of air. The air flow also aids in drying the ink which has been imprinted upon the sheet.

Table 45 has a section cut away slightly past the last fan 70. At this point, the sheet is rotated underneath the surface of table 45 by belt 90 such that the inked side of the sheet which had been face down during imprinting is oriented in a face up direction. The sheet is then released onto conveyor belt 18. Belt 90 initially contacts the sheet near roller 92 as shown in FIGS. 1 and 2. Belt 90 ensures that the sheet remains in contact with a delivery roller 58 until the sheet has passed roller 94 located beneath table 45 as shown in FIG. 2. The orientation of the sheet is thus reversed, and the side of the sheet which was facing down when the sheet was above table 45 is facing upwards when the sheet is below table 45. Belt 90 returns to roller 92 with the assistance of roller 96. The position of roller 94 is set by adjusting bracket 98. A belt 90 of an appropriate length is employed. The type of apparatus which rotates the sheet is a belt-driven device of a type well known in the printing industry.

The present invention has also been adapted to feed envelopes or small sheets by the use of guide bar 100 as shown in FIG. 6. Guide bar 100 is located nearly parallel to the direction of travel of drive belts 46 and 48. In order to feed envelopes, it is necessary that at least drive belt 46, located nearer to the engraving press than drive belt 48 remain in contact with the envelope to be fed. Guide bar 100 is clamped or attached to table 45 through slots located in table 45 (not shown) in a location substantially shown by dashed line 110 in FIG. 1. Guide bar 100 is oriented such that the portion of guide bar 100 nearer press 16 is slightly closer to drive belt 46 than the portion of guide bar 100 nearer sheet feeder 12. This forces the envelopes to remain flush against guide bar 100 as they are fed to press 16, assuring accurate imprinting of the envelopes.

Guide bar 100 consists of a clear Lexan rod 102 attached to an aluminum angle bracket 104. Lexan rod 102 is tapered at one end of guide bar 100 and angle bracket 104 flared at the corresponding end of guide bar 100 in order to create a flared channel 106. Lexan rod 102 is separated from the lower portion of angle bracket 104 in order to form a channel 108 which extends the length of guide bar 100. Channel 108 is wide enough to allow envelopes to pass individually, but not wide enough to permit buckling or folding of the envelopes.

The flared channel end 106 of guide bar 100 is oriented facing sheet feeder 12, and channel 108 facing the engraving press 16. Envelopes are loaded into sheet feeder 12. Size control brackets 32 are adjusted for the size of the envelopes. The portion of openings 38 may be adjusted to feed envelopes, or the opening which is not positioned above the envelopes may be disengaged.

The envelopes are then fed like normal sheets onto the surface of table 45, but will enter channel 108 of guide bar 100 through flared channel 106 as they are fed. Roller 55 is positioned in the same manner for feeding envelopes as it was for feeding sheets. The envelope may only come with contact with one of the fingers of side registration guide 62 to position the envelope beneath engraving press 16. Push rod 64 is de-activated. After imprinting the envelopes, operation of the sheet feeder will continue as if the envelopes were full size sheets.

Table 45 is adjustable positioned with respect to press 16 by the use of positioning adjustment screws 60 and 63. Positioning adjustment screws 60 and 63 may be operated independently, or in conjunction with each other to adjust the sheet positioning towards or away from press 16 or to adjust the angle at which the sheets are oriented with respect to press 16. Positioning adjustment screws 60 and 63 are threaded rods. Mating nuts (not shown) are affixed to table 45 such that the nuts can accommodate angular changes with respect to threaded rods 60 and 63.

In order to determine the timing of various occurrences, such as sucker arm assembly 34 feeding a sheet through feeder roller 36 past drive roller 44 onto belt 46 and 48, when push guide 64 is activated, when the front stopper 62 is raised, and when press 16 imprints the sheet, a series of switches are attached to press cam 80 as shown in FIG. 3.

In the present embodiment, a plurality of pneumatic switches 82 are oriented along cam 80. The pneumatics operate at an air pressure of approximately 10 to 15 pounds per square inch (PSI). Cam 80 is attached to the main drive shaft (not shown) of press 16. Thus, the entire sequence of lifting a sheet, positioning the sheet, imprinting the sheet, and releasing the sheet, are all synchronized with the operation of press 16. Using pneumatic switches in this manner also greatly simplifies the operation of the sheet feeder. There are no intermediary signals to deal with. Each of the elements of the sheet feeder are directly actuated by the rising and falling of a pneumatic switch 82 as cam 80 rotates under the control of the main drive shaft of press 16. Control panel 84 controls activation of each individual element, including individually adjustable air pressure applied to push rod 64, the front stopper 62, vacuum applied to sucker arm assembly 34, and power to fans 66, 68, and 70, drive belts 46 and 48, the sheet feeder 12, feed roller 36, and additional features as may be employed.

Additionally, the present invention eliminates the need for complex mechanical actuators to be driven by a cam arrangement. This greatly reduces the number of moving parts employed by sheet feeder 12. This reduced complexity allows easier access to the sheet feeder by an operator in order to clean the sheet feeder, align sheets, adjust the sheet feeder, and trouble shoot faulty operation.

The inventors recognize that each of the pneumatic switches could be replaced with an electrical switch which in turn drives each of the elements of the sheet feeder, either by actuation of a pneumatic valve, or through implementation using an electrical motor. The inventors further recognize that electronic operation of the present invention can be easily achieved by appropriately scoring cam 80 or a comparable position locating device attached to the main drive shaft of press 16 in order to ascertain the particular point in the cycle of the press operation, and thus actuate appropriate elements of the sheet feeder in a timely manner to ensure sheet delivery and release.

Using pneumatics or electronics allows a great degree of flexibility for imprinting a large number of different size sheets. No re-design or replacement of mechanical components is necessary as with the prior art. Simple, quick adjustment of the front stopper 62, push guide 64, sheet feeder 12 and sheet sensor 72 enables the present invention to change sheet sizes quickly and efficiently.

The inventors have avoided electronic implementation in order to reduce the number of different components which could fail or contribute to operating difficulties. Additionally, electronic or programming skill is not particularly dominant among press operators. The inventors believe that by utilizing mechanical and pneumatic elements, operators will more readily understand and be able to successfully employ the sheet feeder of the present invention in conjunction with an engraving press.

In certain configurations and in the preferred embodiment, the inventors strongly recommend use of a plurality of cams 80, such as is shown in FIG. 4 (more than three cams may be required). This configuration allows independent adjustment of the timing of each of the elements required to operate the automated sheet feeder of the present invention. The inventors have implemented a cam which is 7½ inches in diameter. It is recognized that larger or smaller diameter cams may be readily employed. A larger cam will allow a greater degree of fine tuning of the actuation of each of the elements of the automatic sheet feeder.

The inventors have-found it convenient to mount the cam 80 on the center of the main drive shaft of press 16 in the preferred embodiment of the present invention. Direct mounting may not be possible or preferred in all implementations of the present invention.

The position of the press drive motor 16 may also be ascertained by the use of a feedback coil incorporated into the drive motor of press 16, using a laser to read an encrypted position indicator, or other electronic or mechanical devices.

There has been described hereinabove a novel apparatus for automatically feeding sheets to an engraving press, or the like. Those skilled in the art may now make numerous uses of, and modifications (some of which have been discussed above) to the described implementation of the present invention, which is defined solely by the scope of the following claims.

We claim:

1. An automatic sheet feeder for an engraving press comprising:

a sheet feed unit holding a supply of sheets to be imprinted;

a sheet loading assembly for transferring sheets from said feed unit one sheet at a time;

an essentially planar surface having a length in a direction substantially co-planar with the direction in which sheets are transferred from said sheet loading assembly;

one or more drive belts located on top of said planar surface which conveys sheets across said planar surface, away from said sheet loading assembly;

one or more belt guides positioned above said drive belts to ensure that sheets being conveyed by said drive belts do not lose contact with said drive belts;

said belt guides positioned substantially immediately above each of said drive belts and in which one of said belt guides further comprises one or more rollers;

a front stopper which blocks sheets being conveyed by said drive belts from proceeding past a predetermined point for a predetermined period of time, said front stopper releasing sheets being conveyed by said drive belts after a predetermined period of time;

a push rod for shifting the position of sheets resting against said front stopper from a nonprinting, feeding location in a direction substantially parallel to said front stopper, said push rod shifting the position of the sheet to a location where the sheet is imprinted by the engraving press;

said push rod operated at a relative slow speed to ensure proper location of the sheets prevent the sheets from overshooting the proper, desired location;

said front stopper and push rod being pneumatically or electrically driven; and a sensor oriented to detect the presence of absence of a sheet adjacent to said front stopper.

2. The apparatus of claim 1, wherein said front stopper further comprises a plurality of discrete points.

3. The apparatus of claim 1, wherein operation of said sheet loading assembly, said front stopper and said push rod are synchronized with the operation of the engraving press which imprints the sheets when the sheets are resting against said front stopper and have been positioned by said push rod.

4. The apparatus of claim 1, wherein the position of said front stopper is adjustable in a direction substantially perpendicular to the direction of motion of said drive belts.

* * * * *